United States Patent [19]

Hollingsworth

[11] Patent Number: 4,826,060

[45] Date of Patent: May 2, 1989

[54] COOLER BAG

[76] Inventor: W. Dale Hollingsworth, 742 Ridgefield Rd., Wilton, Conn. 06897

[21] Appl. No.: 169,435

[22] Filed: Mar. 17, 1988

[51] Int. Cl.[4] ..... A45C 13/30; A45F 3/02

[52] U.S. Cl. ..... 224/205; 224/237; 224/258; 224/907; 383/8; 383/16; 383/110; 383/113; 383/117

[58] Field of Search ..... 224/202, 148, 205, 228, 224/237, 257, 258, 264, 269, 907; 383/110, 113, 117, 8, 16

[56] References Cited

U.S. PATENT DOCUMENTS

| | | | |
|---|---|---|---|
| 2,661,785 | 12/1953 | Daust | 383/113 |
| 4,211,091 | 7/1980 | Campbell | 383/110 |
| 4,637,063 | 1/1987 | Sullivan | 383/113 |
| 4,721,237 | 1/1988 | Leslie | 224/148 |
| 4,750,654 | 6/1988 | Menetrier | 224/907 |

*Primary Examiner*—Robert W. Jenkins
*Attorney, Agent, or Firm*—Epstein & Edell

[57] ABSTRACT

A cooler bag intended to be carried at one's back by means of a shoulder strap. The bag is constructed to include an outer layer or shelll and an inner waterproof bladder with the body of the bag having between the outer shell and the bladder a layer of insulation. While the bag is generally circular in cross-section, the bottom of the bag has a forward concave edge portion so as to fit the general contour of one's back. The shoulder strap is selectively connected to the bottom portion of the bag either at one side or the other depending on which shoulder is engaged by the shoulder strap. The bag also has a desirable closure arrangement including closure flaps which are folded into overlying locked relationship.

12 Claims, 2 Drawing Sheets

COOLER BAG

BACKGROUND OF THE INVENTION

1. Technical Field

This invention relates in general to new and useful improvements in bags which one may comfortably and conveniently carry upon one's back and, more particularly, to a bag which is constructed to function as a cooler.

2. Discussion of the Prior Art

Coolers of rigid construction must be carried by a handle disposed at the top of the unit. This is often inconvenient when, for example, one must also carry portable chairs, towels, clothing, etc., when going to a beach or similar recreational facility. There are cooler bags of collapsible, non-rigid construction but these, too, must be carried by a handle. Even if one were to adapt cooler bags to be carried over one's shoulder, the rigid bottom panel required to support cans or bottles of liquid presses against the body of the carrier and causes significant discomfort.

In addition to inconvenience during transport, cooler bags generally suffer from being uni-functional; that is, they cannot carry wet or cold articles along with dry clothing, for example, without getting the dry clothing wet by contact with wet articles or due to condensation, leakage, melting, etc., from the cold articles. Consequently, a second bag must be carried along with the cooler bag in order to transport the dry clothing or other articles. If one must also carry beach chairs, umbrellas, and/or amusement devices, the requirement of a second carrying bag becomes an almost impossible burden.

OBJECTS AND SUMMARY OF THE INVENTION

In accordance with this invention, there is provided a bag which includes a bottom and a body with closure flaps provided at the top of the bag body. The bag in the body area is of a multiple wall construction and includes primarily an outer shell an inner bladder and an intermediate insulation layer. The interior of the bag is subdivided into two or more isolated compartments.

The bag, being particularly adapted to be carried alternatively by a handle or on one's back by means of a strap extending over one's shoulder, has a special bottom construction in that between the outer shell and the bladder there is a stiffening member. The stiffening member, while generally circular in outline, has a concave forward edge portion to match one's back. The lower part of the body of the bag is of a similar outline.

The closure flap arrangement of the bag is also of a novel arrangement wherein the bag may be readily closed and opened with a minimum of effort.

Other objects and advantages of the present invention will become apparent from the following description of the preferred embodiment taken in conjunction with the accompanying drawings.

BRIEF DESCRIPTION OF THE DRAWINGS

These and other objects, features and many of the attendant advantages of the present invention will be better understood upon reading the following detailed description considered in connection with the accompanying drawings, wherein.

DESCRIPTION OF THE PREFERRED EMBODIMENT

Figure 2:
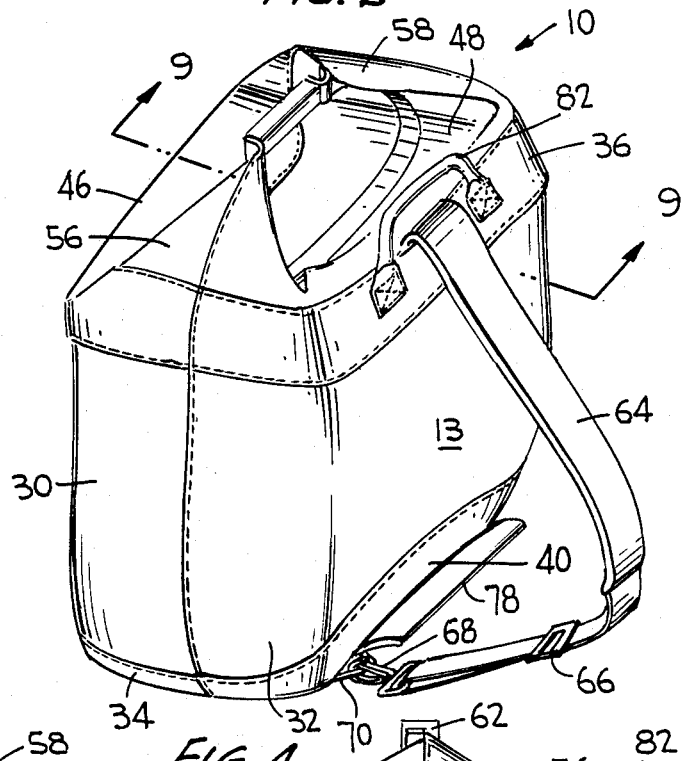
FIG. 2 is a top front perspective view on an enlarged scale of the bag showing further details thereof.
Figure 6:
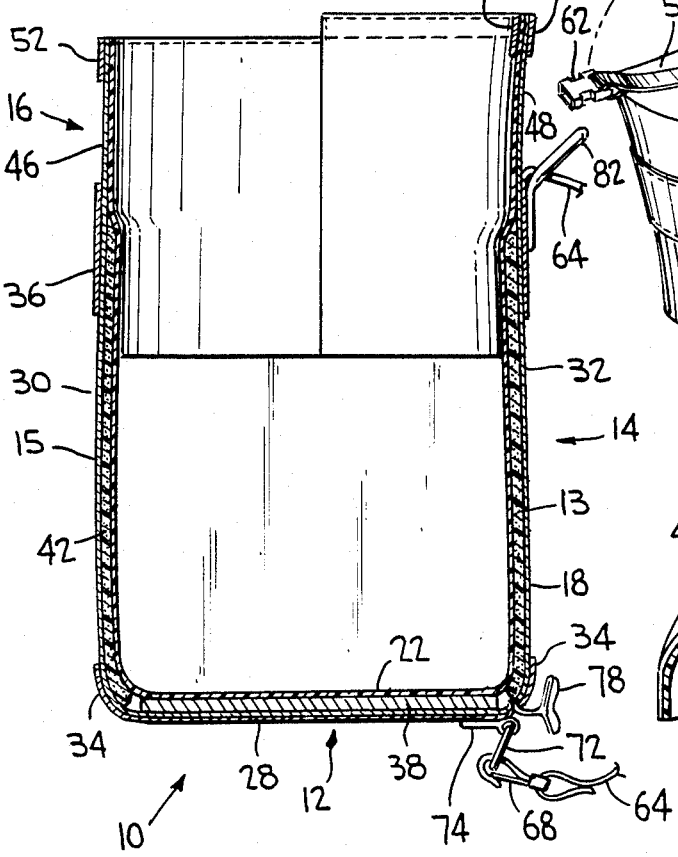
FIG. 6 is an enlarged vertical sectional view taken generally along the line 6—6 of FIG. 5 and shows the constructional details of the bag.

A cooler bag formed in accordance with this invention and generally identified by the numeral 10 is illustrated in FIG. 2. The cooler bag 10, as best shown in FIG. 6, includes basically a bottom 12 and a tubular body 14 terminating at its upper end in an upper close portion 16. Front and rear sides of body 14 are designated by the numerals 13 and 15, respectively. The bag 10 is primarily of a multiple wall construction and includes an outer shell 18 and an inner bladder 20. While the constructional details of the outer shell 18 and the inner bladder 20 may be varied, in a preferred embodiment of the bag construction, the outer shell 18 is formed of 100% cotton woven fabric which may be dyed and has a 0.20 mm PVC film laminated thereto. The bladder is of a different construction and is formed of 100% polyester yarn woven fabric coated with 0.58 mm PVC so as to be waterproof.

The bladder 20 is preferably formed of three pieces of fabric including a bottom member 22 and two upstanding members 24, 26. The members 22, 24 and 26 are joined together by heat bonding which is technically referred to as "welding".

The outer shell 18 is also preferably primarily formed of three portions including a bottom portion 28 and two upstanding wall portions 30, 32. The joint between the wall portions 30, 32 and the bottom body 28 is reinforced by a tape 34 extending circumferentially about the outside of the bag. At the upper end of the body 14, the wall portions 30, 32 are reinforced by a somewhat wider circumferential tape 36 extending about the outside of the bag. All portions of the outer shell 18 are joined together by stitching.

Figure 1:
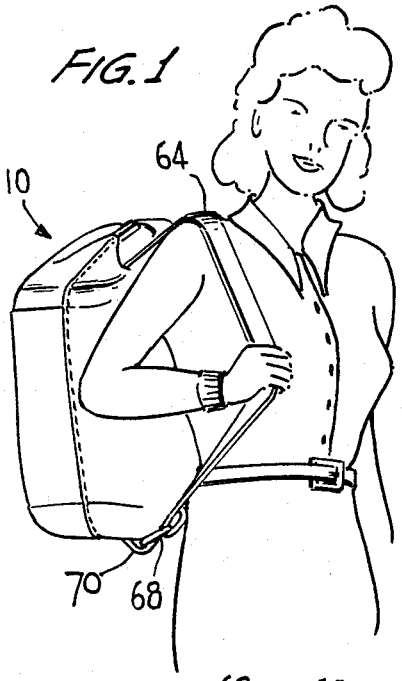
FIG. 1 is a front perspective view of a person carrying a bag formed in accordance with this invention.
Figure 5:
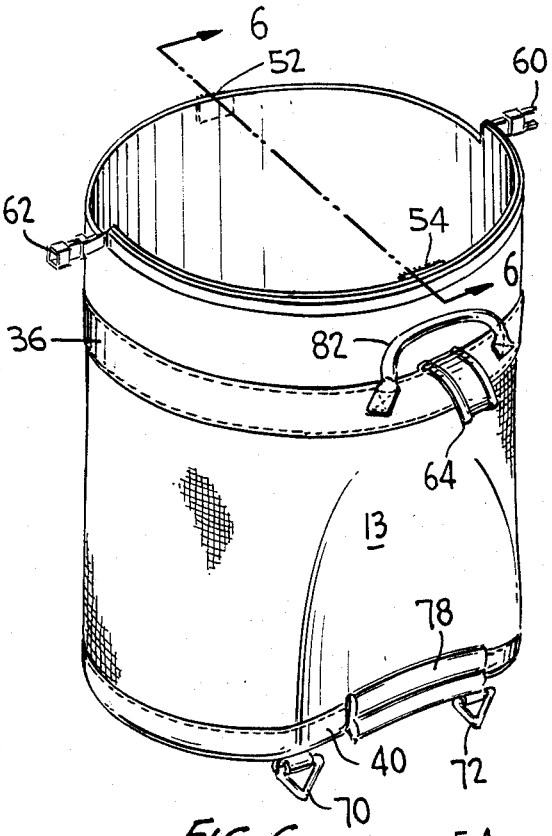
FIG. 5 is a top front perspective view of the bag similar to FIG. 3 with the bag in its opened state.
Figure 7:
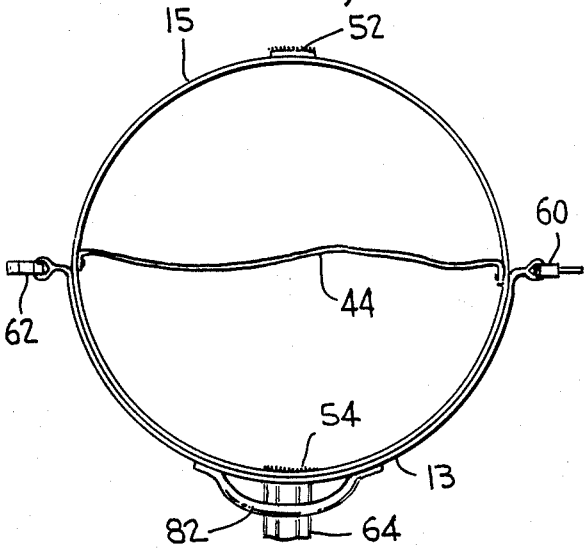
FIG. 7 is a top plan view of the bag in its opened state.

The bag bottom 12 is stiffened by a hard bottom member 38 which is preferably formed by 4 mm thick PVC board. Although the bag 10 is generally of a circular cross-section, as is shown in FIG. 7, the forward edge of the bottom 12 is cut away to define a concave portion as is best shown in FIG. 5 and identified by the reference numeral 40. This concave configuration is intended to be contoured to the carriers back when the bag is being carried over a shoulder, as is best shown in FIG. 1.

The bag 10, in order that it may function as a cooler bag; has a layer of insulation 42 disposed in the body 14 between the outer shell 18 and the bladder 20, as is best shown in FIG. 6. The insulation 42 is preferably a polyethylene sponge foam having a thickness on the order of 5 mm. Further, if desired, the interior of the bag 10 may be divided into at least two compartments by way of one or more transverse dividers 44 best shown in FIG. 7. The divider 44 is preferably formed of the same material as the bladder 20 and has the edges thereof sealed to the bladder by means of heat bonding or "welding".

In addition to the aforedescribed constructional details, the cooler bag 10 has other beneficial features. One of these resides in the closure portion 16. As is best shown in FIG. 6, the outer shell 18 and the bladder 20 are directly joined together beyond the upper termination of the insulation layer 42 so as to define closure portion 16 as a pair of closure flaps 46, 48 located generally beyond the top edge of the reinforcing band 36. Further, it is to be noted that closure flap 48 is longer (i.e., from bottom to top) than closure flap 46 and is reinforced at its upper edge by a strap 50 sewn at least to the outer shell 18.

Referring now to FIG. 5, it will be seen that the closure flap 46 has bonded to the exterior surface thereof at the upper edge thereof one part of a known type of releasable fastener, the part being identified by the numeral 52. A cooperating part of the known type of fastener is bonded to the inner surface of the closure flap 48 at the upper edge thereof. This part is identified by the numeral 54. The fastening parts 52, 54 are generally diametrically oppositely related and are positioned for releasable interlocking engagement when the closure flaps 46, 48 are folded in place, as is shown in FIGS. 8 and 9.

Figure 8:
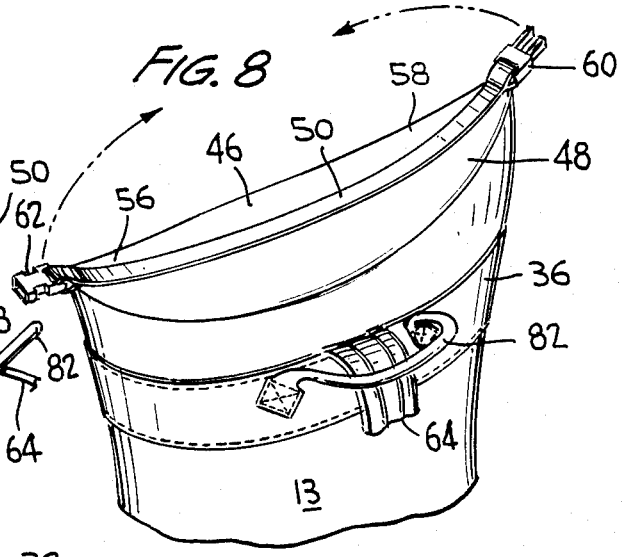
FIG. 8 is a fragmentary front perspective view showing the bag in its partially closed state.
Figure 9:
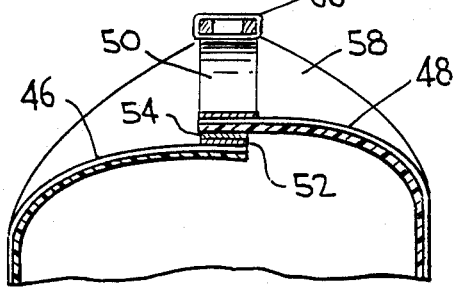
FIG. 9 is an enlarged fragmentary vertical sectional view taken generally along the line 9—9 of FIG. 2 and shows the cooperation between the closure flaps and latch means for retaining tab ends of the closure flaps in overlying folded relation.

When the closure flaps 46, 48 are folded to their bag closing positions as shown in FIG. 8, there are defined remote tabs 56. 58. At this time the strap 50 extends across the top of the closed bag. It is to be noted that at opposite ends of the strap 50 there are cooperating latch elements 60, 62 which interlock with one another when the tabs 56, 58 are folded into overlying relation towards one another in the manner best shown in FIG. 2. This arrangement provides for a complete sealed closing of the bag 10.

Figure 4:
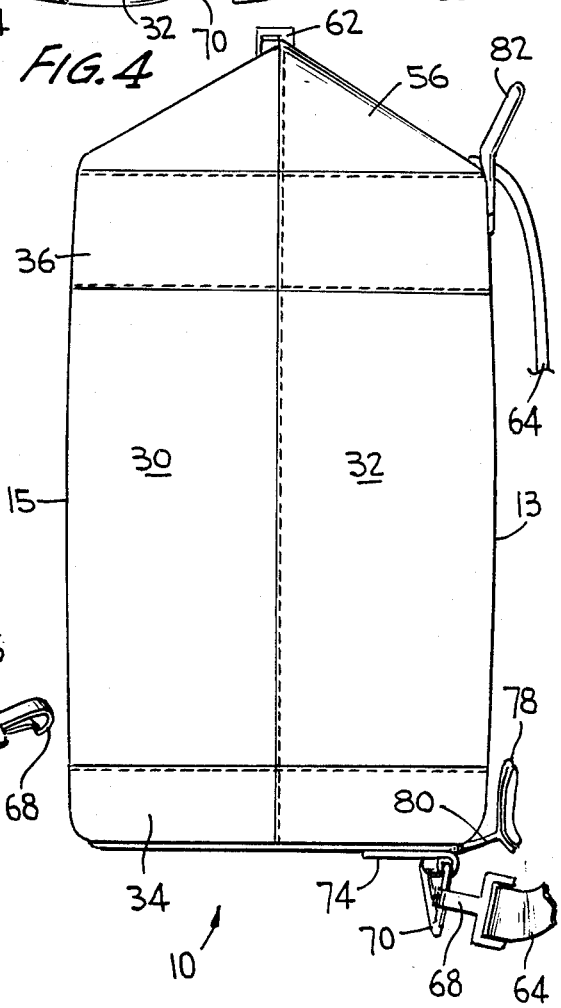
FIG. 4 is a side elevational view of the bag with a portion of the carrying strap broken away, but connected to the bag bottom.

Another beneficial feature of the bag 10 is the construction thereof for carrying on one's back by way of a strap engaged over one's shoulder as is best shown in FIG. 1. To this end, at the front 13 of the bag 10 there is sewn to the reinforcing band 36 an upper end of a should strap 64. The shoulder strap 64 is provided with length adjusting means 66 and is provided at the bottom end thereof with a hook member 68. The bag bottom carries adjacent the front edge of the bag bottom two transversely spaced eye members 70, 72 which are selectively engaged by the hook 68. The eyes 70, 72 are secured to the bottom by means of straps 74, as is best shown in FIG. 4, so as to pivotally mount the eye members.

With reference to FIG. 1, it will be seen that depending on which shoulder is engaged by the strap 64, one of the eye members 70, 72 is selected. Thus, when the strap 64 is engaged over the right shoulder, the eye member 70 is engaged by the hook 68 and when the strap 64 is engaged over the left shoulder, the hook 68 engages the eye member 72.

At this time it is to be noted that there is carried by the front bottom recessed portion 40 of the bag 10 a pad 78 which is hingedly connected to the bag bottom by a web 80. The pad 78 is positioned in the concave configuration of the bag bottom and is a back engaging pad so as to make the carrying of the bag 10 more comfortable.

Figure 3:
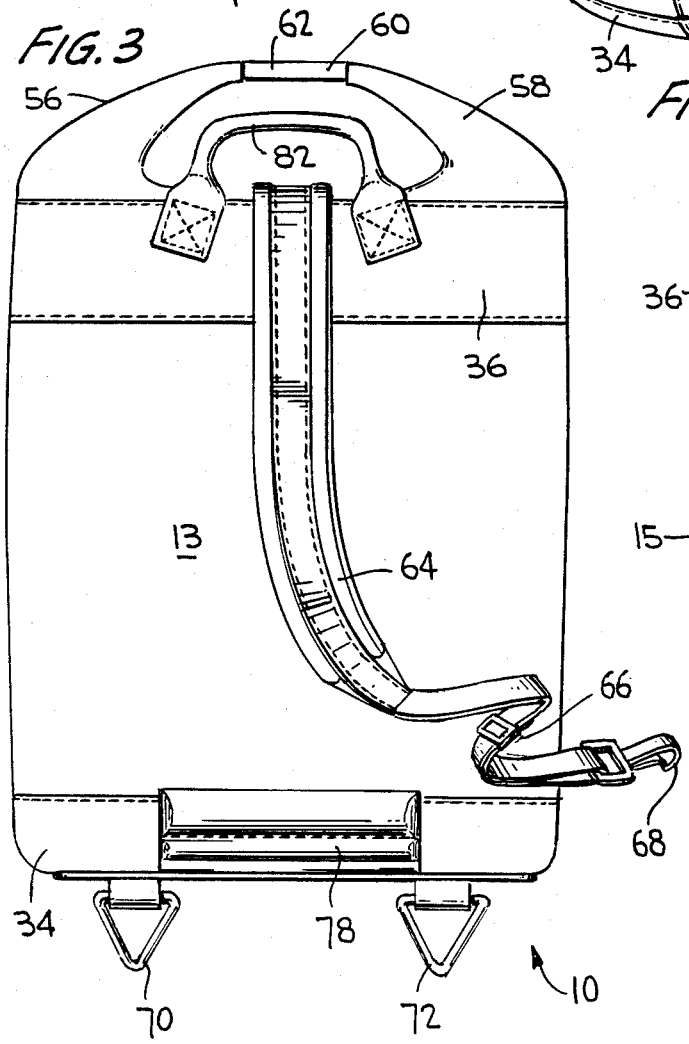
FIG. 3 is an enlarged front elevational view of the bag with the carrying strap detached from the bag bottom.

Finally, in order to facilitate lifting of the bag, the front portion of the band 36 has sewn thereto an upstanding handle 82. The handle 82 preferably straddles the upper end of the strap 64 and, in the closed position of the bag, projects generally above the sealed closure flaps 46, 48 as is best shown in FIGS. 2 and 3. It is to be noted that the reinforcing band defined by the circumferential tape 36 generally defines a fold line for each of the closure flaps 46, 48.

Although the bag 10 is specifically of an insulated construction so that it may function as a cooler, it is to be understood that the bag has general utility.

Inasmuch as the present invention is subject to many variations, modifications and changes in details, it is intended that all subject matter discussed above or shown in the accompanying drawings be interpreted as illustrative and not in a limiting sense.

What I claim is:

1. A cooler bag comprising a bottom, a body extending upwardly from said bottom, said body having a top portion terminating in a top closure, said bag having an overall outer shell, an inner bladder, and insulation between said outer shell and said bladder at least in said body, wherein said bladder is formed of a woven fabric having a plastic coating so as to be waterproof, said bladder being formed in sections, and all of said bladder sections being joined to one another by heat bonding.

2. A cooler bag according to claim 1 wherein said bag has strap means for carrying said bag generally on one's back, and said bottom includes an insert for stiffening said bottom, said insert having a concave edge portion for fitting one's back.

3. A cooler bag comprising a bottom, a body extending upwardly from said bottom, said body having a top portion terminating in a top closure, said bag having an overall outer shell, an inner bladder, and insulation between said outer shell and said bladder at least in said body, wherein said bottom is stiffened by a generally rigid insert, wherein said bag has strap means for carrying said bag generally on one's back, and said bottom including said insert having a concave forward edge portion generally in alignment with said strap means and contoured for fitting one's back.

4. A cooler bag according to claim 3 wherein there is a back cushion at said bottom in alignment with said concave edge portion so as to be disposed between that portion and one's back.

5. A cooler bag according to claim 3 wherein said strap means includes a strap having an end connected with said body generally at an upper end of said body, and said bottom has an underside carrying anchor means for said strap.

6. A cooler bag according to claim 5 wherein the connection between said strap and the upper end of said body is generally transversely centered relative to said concave portion, and there are two of said anchor means, one generally at each end of said concave outline, said two anchor means being selectively engageable by said strap in accordance with that shoulder of a user with which said strap is to be engaged.

7. A cooler bag according to claim 5 wherein there is a handle carried by said body generally at said upper end of said body in centered relation to said strap.

8. A cooler bag according to claim 7 wherein there is an external reinforcing band around said body at the upper end of said body, and said strap and said handle being secured to said reinforcing band.

9. A cooler bag comprising a bottom, a body extending upwardly from said bottom, said body having a top portion terminating in a top closure, said bag having an overall outer shell, an inner bladder, and insulation between said outer shell and said bladder at least in said body, wherein said top closure includes extensions of said body generally in the form of closure flaps connected to said body for folding into overlapping bag closing relation, wherein said closure flaps when in said overlapping bag closing relation define a pair of remote tabs, and releasable latch means carried by said tabs for releasably joining together said tabs with said tabs being in folded overlapping relation to said overlapping closure flaps, wherein one of said closure flaps is an outermost closure flap and is of a greater width than the other of said closure flaps, said one closure flap having a free edge reinforced by a strap, and said latch means being carried by said strap.

10. A cooler bag comprising a bottom, a body extending upwardly from said bottom, said body having a top portion terminating in a top closure, said bag having an overall outer shell, an inner bladder, and insulation between said outer shell and said bladder at least in said body, wherein said top closure includes extensions of said body generally in the form of closure flaps connected to said body for folding into overlapping bag closing relation, wherein said closure flaps when in said overlapping bag closing relation define a pair of remote tabs, and releasable latch means carried by said tabs for releasably joining together said tabs with said tabs being in folded overlapping relation to said overlapping closure flaps, wherein one of said closure flaps is an outermost closure flap, said one closure flap has a free edge reinforced by a woven strap, and said latch means being carried by said woven strap.

11. A cooler bag comprising a bottom, a body extending upwardly from said bottom, said body having a top portion terminating in a top closure, said bag having an overall outer shell, an inner bladder, and insulation between said outer shell and said bladder at least in said body, wherein said top closure includes extensions of said body generally in the form of closure flaps connected to said body for folding into overlapping bag closing relation, wherein there is an external reinforcing band around said body at an upper end of said body, said reinforcing band defining generally fold lines for said closure flaps.

12. A bag comprising a bottom, a body, said body having a top portion terminating in a top closure, said bottom being stiffened by a generally rigid insert, said bag having strap means for carrying said bag generally on one's back, and said bottom including said insert being of a concave edge portion generally in alignment with said strap means for fitting one's back.

* * * * *